US008291971B2

(12) United States Patent
Lopez et al.

(10) Patent No.: US 8,291,971 B2
(45) Date of Patent: Oct. 23, 2012

(54) CRIMPED END WRAPPED ON PIPE WELL SCREEN

(75) Inventors: Jean-Marc Lopez, Plano, TX (US); Gregory Scott Cunningham, Grapevine, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 245 days.

(21) Appl. No.: 12/855,932

(22) Filed: Aug. 13, 2010

(65) Prior Publication Data

US 2012/0037357 A1 Feb. 16, 2012

(51) Int. Cl.
*E21B 43/08* (2006.01)
*E03B 3/20* (2006.01)

(52) U.S. Cl. ..... 166/227; 166/230

(58) Field of Classification Search ..... 166/227, 166/228, 230
See application file for complete search history.

(56) References Cited

U.S. PATENT DOCUMENTS

| | | | | |
|---|---|---|---|---|
| 1,976,217 | A | | 10/1934 | Diepenbrock |
| 3,515,280 | A | * | 6/1970 | Parker ..... 210/314 |
| 3,908,256 | A | | 9/1975 | Smith, III |
| 3,958,634 | A | | 5/1976 | Smith, III |
| 4,204,967 | A | | 5/1980 | Bannister |
| 4,428,423 | A | | 1/1984 | Koehler et al. |
| 4,771,829 | A | | 9/1988 | Sparlin |
| 5,152,892 | A | | 10/1992 | Chambers |
| 5,190,102 | A | | 3/1993 | Arterbury et al. |
| 5,310,000 | A | | 5/1994 | Arterbury et al. |
| 5,339,895 | A | | 8/1994 | Arterbury et al. |
| 5,355,948 | A | | 10/1994 | Sparlin et al. |
| 5,611,399 | A | | 3/1997 | Richard et al. |
| 5,624,560 | A | | 4/1997 | Voll et al. |
| 5,642,781 | A | | 7/1997 | Richard |
| 5,738,170 | A | | 4/1998 | Lavernhe |
| 5,787,980 | A | | 8/1998 | Sparlin et al. |
| 5,849,188 | A | | 12/1998 | Voll et al. |
| 5,901,789 | A | | 5/1999 | Donnelly et al. |
| 5,909,773 | A | | 6/1999 | Koehler et al. |
| 5,918,672 | A | | 7/1999 | McConnell et al. |
| 5,938,925 | A | | 8/1999 | Hamid et al. |
| 5,979,551 | A | | 11/1999 | Uban et al. |
| 5,980,745 | A | | 11/1999 | Voll et al. |
| 6,092,604 | A | | 7/2000 | Rice et al. |
| 6,305,468 | B1 | | 10/2001 | Broome et al. |

(Continued)

FOREIGN PATENT DOCUMENTS

WO WO/03100211 12/2003

OTHER PUBLICATIONS

Notification of Transmittal of the International Search Report (5 pages); and Written Opinion of the International Searching Authority (3 pages), mailed Dec. 29, 2011, for related international application PCT/US2011/046731.

(Continued)

*Primary Examiner* — William P Neuder
(74) *Attorney, Agent, or Firm* — Fish & Richardson P.C.

(57) ABSTRACT

A well screen is constructed by positioning a crimp ring encircling and over an end of a wrapped-on-pipe screen layer on a tubular base pipe. The crimp ring is plastically deformed about an outer surface of the screen layer. A bead of weld is applied to affix the crimp ring to the base pipe.

24 Claims, 4 Drawing Sheets

U.S. PATENT DOCUMENTS

| | | | | |
|---|---|---|---|---|
| 6,315,040 | B1 | 11/2001 | Donnelly et al. | |
| 6,391,200 | B2 | 5/2002 | Pulek et al. | |
| 6,612,481 | B2 | 9/2003 | Bode | |
| 6,715,544 | B2 | 4/2004 | Gillespie et al. | |
| 6,745,843 | B2 | 6/2004 | Johnson et al. | |
| 6,776,241 | B2 | 8/2004 | Castano-Mears et al. | |
| 6,941,652 | B2 | 9/2005 | Echols et al. | |
| 7,287,684 | B2 | 10/2007 | Blackburne, Jr. | |
| 7,841,409 | B2 | 11/2010 | Gano et al. | |
| 8,146,662 | B2 * | 4/2012 | Shoemate | 166/278 |
| 8,176,634 | B2 * | 5/2012 | Bonner et al. | 29/896.62 |
| 2002/0117440 | A1 | 8/2002 | Cross et al. | |
| 2002/0189808 | A1 | 12/2002 | Nguyen et al. | |
| 2003/0066651 | A1 | 4/2003 | Johnson | |
| 2003/0141061 | A1 | 7/2003 | Hailey, Jr. et al. | |
| 2004/0026313 | A1 | 2/2004 | Arlon Fischer | |
| 2005/0014429 | A1 | 1/2005 | Tueshaus et al. | |
| 2005/0082061 | A1 | 4/2005 | Nguyen et al. | |
| 2005/0126779 | A1 | 6/2005 | Arterbury | |
| 2005/0272329 | A1 | 12/2005 | Tueshaus et al. | |
| 2006/0137883 | A1 | 6/2006 | Kluger et al. | |
| 2006/0186601 | A1 | 8/2006 | Lopez | |
| 2007/0012444 | A1 | 1/2007 | Horgan et al. | |
| 2007/0199889 | A1 | 8/2007 | Tueshaus et al. | |
| 2007/0256834 | A1 | 11/2007 | Hopkins et al. | |
| 2008/0035330 | A1 | 2/2008 | Richards | |
| 2008/0283239 | A1 | 11/2008 | Langlais et al. | |
| 2008/0289815 | A1 | 11/2008 | Moen et al. | |
| 2009/0084556 | A1 | 4/2009 | Richards et al. | |
| 2009/0229823 | A1 | 9/2009 | Moen et al. | |
| 2010/0000742 | A1 | 1/2010 | Bonner et al. | |
| 2010/0122447 | A1 | 5/2010 | Peterson | |
| 2010/0163481 | A1 | 7/2010 | McGrenera et al. | |
| 2010/0252250 | A1 | 10/2010 | Fripp et al. | |
| 2010/0258300 | A1 | 10/2010 | Shoemate | |
| 2010/0258301 | A1 | 10/2010 | Bonner et al. | |
| 2010/0258302 | A1 | 10/2010 | Bonner et al. | |

OTHER PUBLICATIONS

Notification Concerning Transmittal of International Preliminary Report on Patentability (2 pages); and Written Opinion of the International Searching Authority (3 pages), mailed Oct. 20, 2011, for related international application PCT/US2010/030264.

"Standard Specification for Industrial Woven Wire Cloth"; ASTM International; Designation E-2016-06; 2006, 29 pages.

G. Gillespie et al. "Collapse and Burst Test Methods for Sand Screens"; SPE 116094 paper presented at the 2008 SPE Conference on Sep. 21-24, 2008; Denver, Co: 15 pages.

G. Gillespie et al. "Screen Development to Withstand 4,000-psi Overbalance, Subhydrostatic Completion in Deepwater GOM Subsea Waterflood Injector Wells", SPE 116091 paper presented at the 2008 SPE Conference on Sep. 21-24, 2008; Denver, CO; 18 pages.

* cited by examiner

CRIMPED END WRAPPED ON PIPE WELL SCREEN

BACKGROUND

This description relates to filtration apparatus for use in subterranean wellbores.

For centuries, wells have been drilled to extract oil, natural gas, water, and other fluids from subterranean formations. In extracting the fluids, a production string is provided in a wellbore, both reinforcing the structural integrity of the wellbore, as well as assisting in extraction of fluids from the well. To allow fluids to flow into production string, apertures are often provided in the tubing string in the section of the string corresponding with production zones of the well. Although perforations allow for ingress of the desired fluids from the formation, these perforations can also allow unwanted materials to flow into the well from the surrounding foundations during production. Debris, such as formation sand and other particulate, can fall or be swept into the tubing together with formation fluid, contaminating the recovered fluid. Not only do sand and other particulates contaminate the recovered fluid, this particulate can cause many additional problems for the well operator. For example, as the particulate flows through production equipment, it gradually erodes the equipment, accumulate in chambers, and block flow passages. Repairing and replacing production equipment damaged by particulate in-flow can be costly and time-consuming, particularly for downhole equipment sometimes located several thousand feet below the Earth's surface. Consequently, to guard against particulate from entering production equipment, while at the same time preserving sufficient fluid flow pathways, various production filters and filtration methods have been developed and employed including gravel packs and well screen assemblies.

A number of well screen filtration designs have been employed. A well screen assembly is a screen of one or more layers installed in the well, capable of filtering against passage of particulate of a specified size and larger, such as sand, rock fragments and gravel from surrounding gravel packing. The specific design of the well screen can take into account the type of subterranean formation likely to be encountered, as well as the well-type.

SUMMARY

This description relates to filtration apparatus for use in subterranean wellbores, for example, well screen assemblies.

In certain aspects, a well screen assembly has an elongate tubular base pipe defining apertures extending between the interior and exterior of the base pipe. A screen layer is carried on the base pipe and includes a wire that has been wrapped helically around the exterior of the base pipe. A crimp ring is affixed to the base pipe and encircles the base pipe and an end of the screen layer. The crimp ring is plastically deformed about an outer surface of the screen layer.

In certain aspects, a method for constructing a well screen assembly includes positioning a crimp ring encircling and over an end of a wrapped-on-pipe screen layer on a tubular base pipe. The crimp ring is plastically deformed about an outer surface of the screen layer. Weld is applied to affix the crimp ring to the base pipe.

In certain aspects, a method includes wrapping a wire helically around a base pipe to define a screen layer. A crimp ring is introduced over an end of the screen layer. The crimp ring is plastically deformed around the screen layer and securing the screen layer to the base pipe.

One or more of the aspects include some, none or all of the following features. In certain instances, an end ring is affixed to the base pipe and encircles the base pipe. The crimp ring is plastically deformed about an outer surface of the end ring. The crimp ring is welded to the end ring, and the end ring is welded to the base pipe. The end ring is continuous or split. In certain instances, the split end ring includes a plurality of arcuate ring segments assembled about the base pipe. In certain instances, the end ring is omitted and the crimp ring is welded to the base pipe. The crimp ring is deformed into contact with the outer surface of the screen layer. In certain instances, the material of the screen layer and the material of the base pipe are incompatible for welding. In certain instances, a second crimp ring is affixed to the base pipe and encircles the base pipe and a second end of the screen layer, the second crimp ring plastically deformed about the outer surface of the screen layer.

The details of one or more implementations are set forth in the accompanying drawings and the description below. Other features, objects, and advantages will be apparent from the description and drawings, and from the claims.

DESCRIPTION OF DRAWINGS

FIGS. 2A-2C are half side cross-sectional views of a well screen assembly constructed in accordance with the concepts described herein, wherein FIG. 2A illustrates the completed well screen assembly, FIG. 2B illustrates the well screen assembly prior to crimping, and FIG. 2C illustrates the well screen assembly after crimping.

FIGS. 4A-4C are half side cross-sectional views of another well screen assembly constructed in accordance with the concepts described herein, wherein FIG. 4A illustrates the completed well screen assembly, FIG. 4B illustrates the well screen assembly prior to crimping, and FIG. 4C illustrates the well screen assembly after crimping.

Like reference symbols in the various drawings indicate like elements.

DETAILED DESCRIPTION

Figure 1:
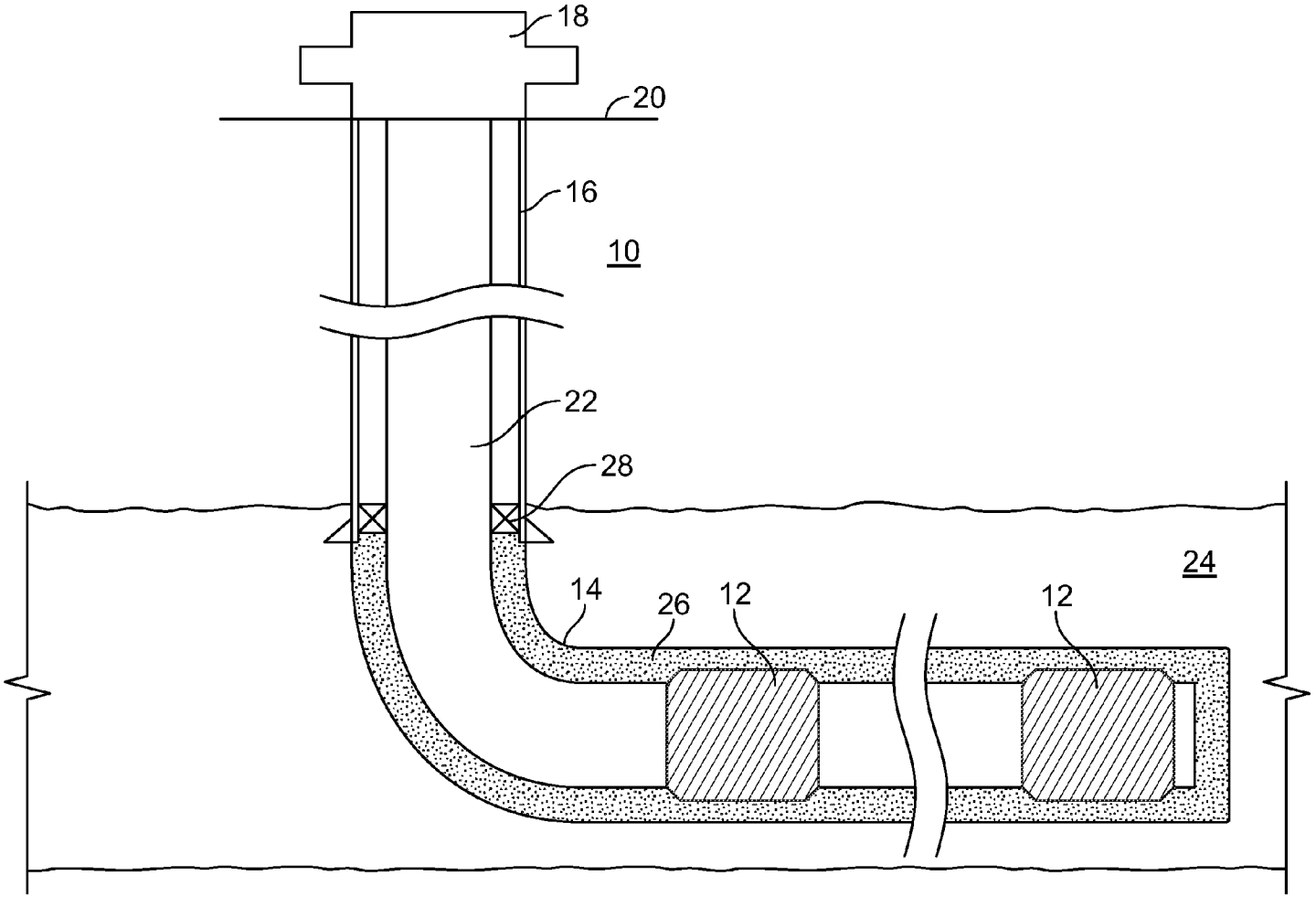
FIG. 1 is a side cross-sectional view of an example well system including a plurality of well screen assemblies constructed in accordance with the concepts described herein.

FIG. 1 illustrates an example well system 10 including a plurality of well screen assemblies 12. The well system 10 is shown as being a horizontal well, having a wellbore 14 that deviates to horizontal or substantially horizontal in the subterranean zone of interest 24. A casing 16 is cemented in the vertical portion of the wellbore and coupled to a wellhead 18 at the surface 20. The remainder of the wellbore 14 is completed open hole (i.e., without casing). A production string 22 extends from wellhead 18, through the wellbore 14 and into the subterranean zone of interest 24. A production packer 28 seals the annulus between the production string 22 and the casing 16. The production string 22 operates in producing fluids (e.g., oil, gas, and/or other fluids) from the subterranean zone 24 to the surface 20. The production string 22 includes one or more well screen assemblies 12 (two shown). In some instances, the annulus between the production string 22 and the open hole portion of the wellbore 14 may be packed with gravel and/or sand (hereinafter referred to as gravel packing 26 for convenience). The well screen assemblies 12 and gravel packing 26 allow communication of fluids between the production string 22 and subterranean zone 24. The gravel packing 26 provides a first stage of filtration against passage of particulate and larger fragments of the formation to the production string 22. The well screen assemblies provide a second stage of filtration, and are configured to filter against passage of particulate of a specified size and larger into the production string 22.

Although shown in the context of a horizontal well system 10, well screen assemblies 12 can be provided in other well configurations, including vertical well systems having a vertical or substantial vertical wellbore, multi-lateral well systems having multiple wellbores deviating from a common wellbore and/or other well systems. Also, although described in a production context, well screen assemblies 12 can be used in other contexts, including injection, well treatment and/or other applications.

Figure 2A:
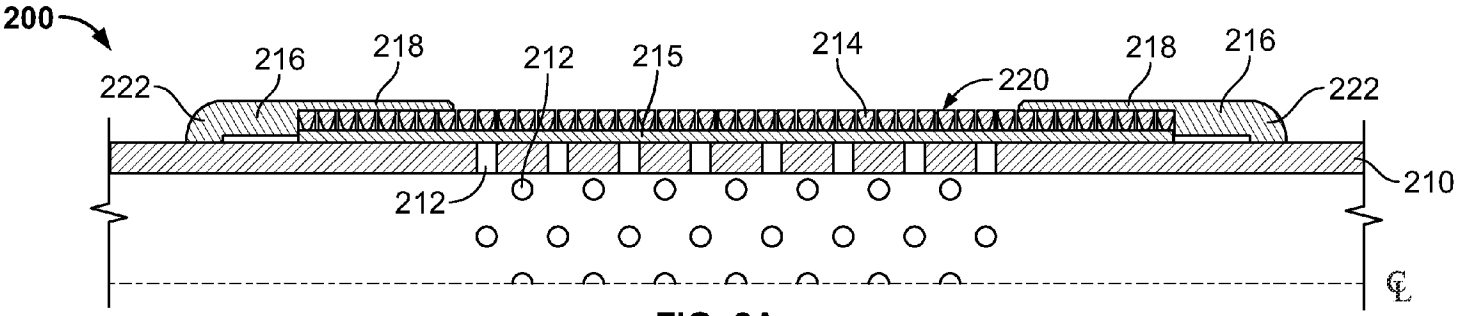
Figure 2B:
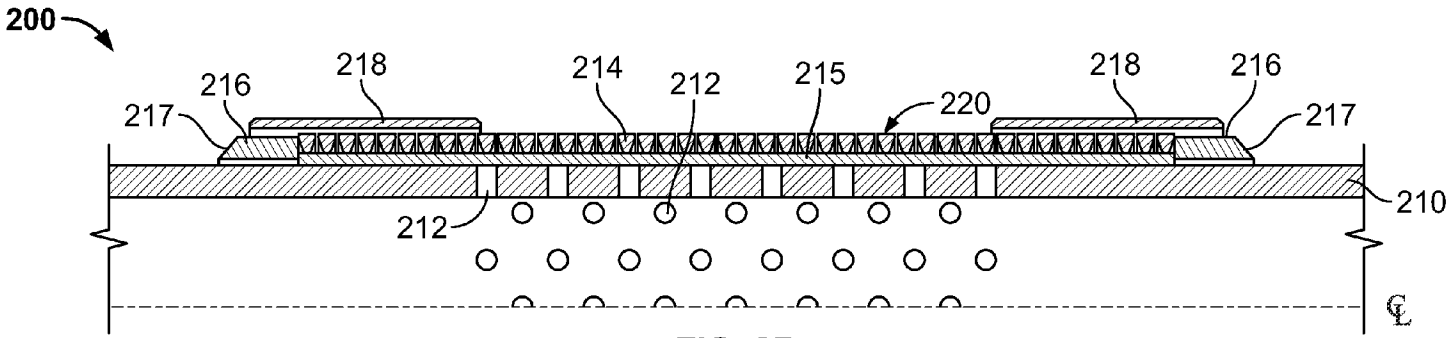
Figure 2C:
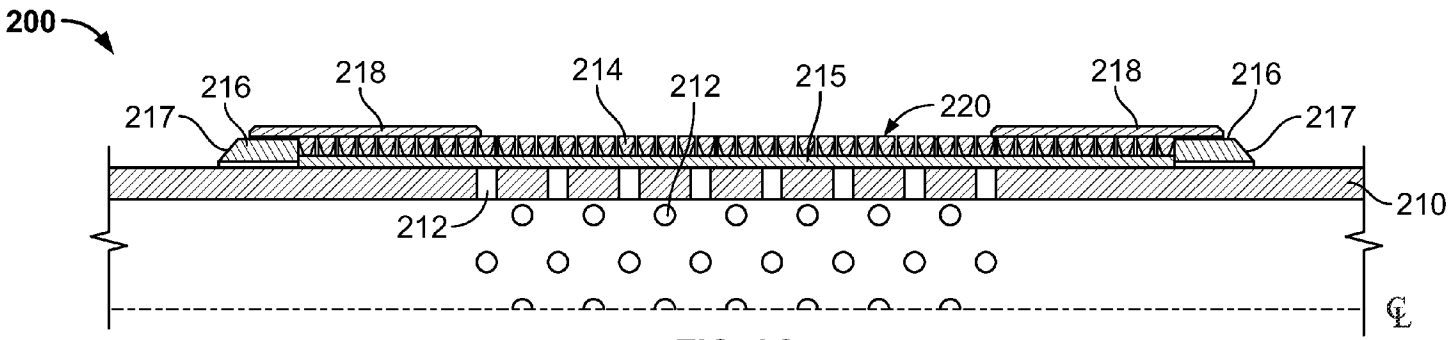

FIGS. 2A-2C are half side cross-sectional views of a well screen assembly 200 constructed in accordance with the concepts described herein. The well screen assembly 200 includes an elongate tubular base pipe 210 that carries a wrapped-on-pipe screen layer 220. The base pipe has a plurality of apertures 212 between the interior and exterior of the base pipe to allow communication of fluid between the interior and the exterior. In certain instances, the ends of the base pipe 210 are adapted to couple to other tubulars of a well string (e.g., by box and pin and/or otherwise). The wrapped-on-pipe screen layer 220 is a type of screen formed by wrapping a wire 214 helically around the exterior of the base pipe 210. In certain instances, an axial rib 215 is provided between the screen layer 220 and the base pipe 210 when the wire 214 is wrapped around the exterior of the base pipe 210. The wire 214 can be welded to the rib 215 as it is wrapped. The screen layer 220 functions to filter against passage of particulate of a specified size and larger into the interior of the base pipe 210. Thus, in certain instances, the pitch of the helix is selected such that the space between adjacent turns of wire 214 at the location where the wire 214 turns are closest together is at least smaller than the specified size of the particulate. In certain instances, the screen layer 220 can filter against passage of gravel and/or sand sized particulate. The wire 214 can take the form of a number of different shapes. For example, in FIG. 2A, the wire 214 is trapezoidal in axial cross-section, having a larger transverse dimension at the outer surface of the screen layer 220 than at the inner surface of the screen layer 220. In other instances, the wire 214 can have other different shapes, including triangular, circular, elliptical, square, and other shapes.

The screen assembly 200 is formed by wrapping the wire 214 helically around the exterior of the base pipe 210. Then, a end ring 216 is placed on the base pipe 210, encircling the base pipe 210 and adjacent, and in some instances adjacent and contacting, the end of the screen layer 220. In certain instances, the end ring 216 can be a continuous ring. In certain instances the end ring 216 can be split such that the end ring can be opened and placed laterally over the base pipe 210, rather than requiring the end ring to be introduced over the end of the base pipe 210 and passed over the base pipe 210 into position. In certain instances, the end ring 216, when split, need not account for irregularities (e.g., ovality, thickness and diameter variations, and other irregularities) over the entire or other length of the base pipe 210, because it need not pass over the length of the base pipe 210. Furthermore, in certain instances, it can be more convenient to place the end ring 216 laterally over the base pipe 210 when, for example, the screen layer 220 terminates intermediate a length of the base pipe 210 rather than adjacent an end.

Figure 3A:
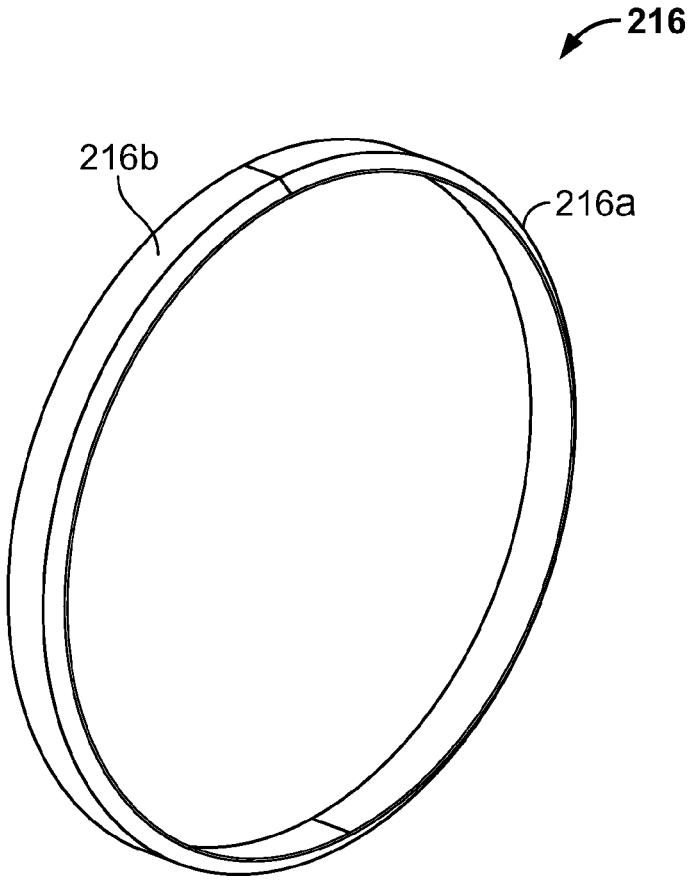
FIG. 3A is a perspective view of an end ring constructed in accordance with the concepts described herein.

The split end ring 216 can be two or more arcuate, C-shaped ring segments 216*a*, 216*b* as in FIG. 3A that are assembled around the base pipe 210. In other instances, the end ring 216 can be a substantially complete ring with a single cut to allow the end ring 216 to be opened and the base pipe 210 received through the cut. A notch or partial cut can be provided opposite the single cut to facilitate opening the end ring 216. Other configurations are likewise possible. In certain instances, the outer diameter of the end ring 216, when assembled around the base pipe 210, is equal to or slightly smaller than the outer diameter of the screen layer 220. The inner diameter of the split ring 216 is equal to or slightly larger than the outer diameter of the base pipe 210. The inner diameter of the split ring 216 can be a loose fit over the base pipe 210 to accommodate variations in the base pipe 210 outer diameter, ovality, and/or other irregularities of the base pipe 210.

The end ring 216 is secured to the base pipe and/or the screen layer 220. In certain instances, the end ring 216 is tack welded to the base pipe 210 and/or the screen layer 220. Tack welding is a technique where short segments or points of weld are applied at spaced out intervals, rather than a continuous or a long stitch weld. In other instances, the end ring 216 can be clamped, secured by fasteners, secured with adhesive, and/or secured another manner. The end ring 216 need not be permanently and strongly secured to the base pipe 210, because as is discussed below, the end ring 216 will be further secured to the base pipe in a later construction step. In certain instances, the end ring 216 is provided with a weld bevel 217 opposite the surface facing the screen layer 220 to facilitate formation of a weld bead between the end ring 216 and the outer surface of the base pipe 210.

Figure 3B:
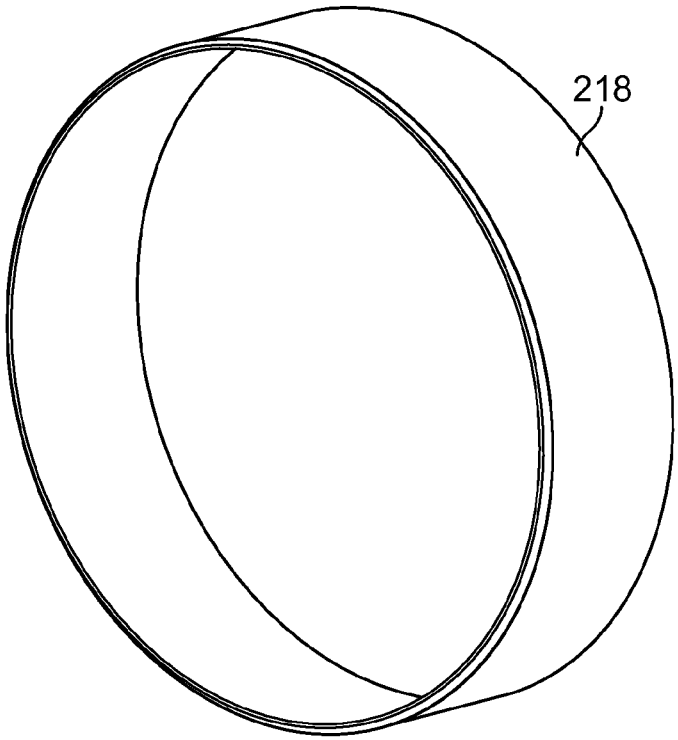
FIG. 3B is a perspective view of a crimp ring constructed in accordance with the concepts described herein.

A crimp ring 218 (FIG. 3B) is positioned encircling and over the interface between the end ring 216 and the screen layer 220, such that a portion of the crimp ring 218 resides over the end of the screen layer 220 and a portion of the crimp ring 218 resides over the end ring 216. In certain instances, the crimp ring 218 can overlap the screen layer 220 by 1-2 inches or more. In certain instances, the crimp ring 218 can overlap the screen layer 220 by less. The crimp ring 218 can be a loose fit over the base pipe 210 to accommodate variations in the screen layer 220 outer diameter, ovality, and/or other irregularities of the screen layer 220, and allow the crimp ring 218 to be received over the end of the screen layer 220 and moved over the screen layer into location. Once in position, the crimp ring 218 is crimped, i.e., plastically deformed, into close relationship and/or contact with the outer surface of the screen layer 220 and the split ring 216 (compare FIGS. 2B and 2C). In certain instances, to prevent passage of the specified size particulate, it is desirable to crimp the crimp ring 218 into continuous contact around the entire circumference of the screen layer 220. In certain instances, to prevent passage of the specified size particulate, all or a portion of the crimp ring 218 can be crimped to close, but spaced apart proximity to the screen layer 220 with a largest radial gap between the crimp ring 218 and screen layer 220 being at least smaller than the specified size of particulate filtered by the screen layer 220.

Thereafter, the crimp ring 218, end ring 216 and base pipe 210 are welded together by forming one or more beads of weld 222 circumferentially around and contacting the interface between the crimp ring 218 and the end ring 216 and the interface between the end ring 216 and the base pipe 210 as shown in FIG. 2A. The beads of weld 222 can be deposited by welding, brazing, soldering, as polymer epoxy and/or other means. Welding is joining the materials by coalescing the materials and/or a filler material. Brazing and soldering, in the context of metallic components, are joining the metals without coalescing the materials. The beads of weld 222 can be continuous and seal against passage of the specified size of particulate and/or fluid between the crimp ring 218 and end ring 216 interface and between the end ring 216 and base pipe 210, and secures the end ring 216, crimp ring 218 and screen layer 220 to the base pipe 210. In certain instances, an O-ring can additionally or alternately be provided between crimp ring 28 and end ring 216 and/or the base pipe 210 and the end ring 216 to seal against passage of the specified size of particulate and/or fluid. A similar or identical assembly of crimp ring 218 and end ring 216 can be installed on opposing ends of the screen layer 220. The crimp rings 218 and end rings 216 then bracket the screen layer 220 and retain the screen layer 220 from axially moving on the base pipe 210, as well as prevent specified size particulate from passing between the base pipe 210 and screen layer 220 at the ends of the screen layer 220.

Because the base pipe 210 and crimp ring 218 need not be welded to the screen layer 220, the screen layer 220 can be made of materials that cannot be welded or readily welded with the materials of the base pipe 210 and crimp ring 218.

Figure 4A:
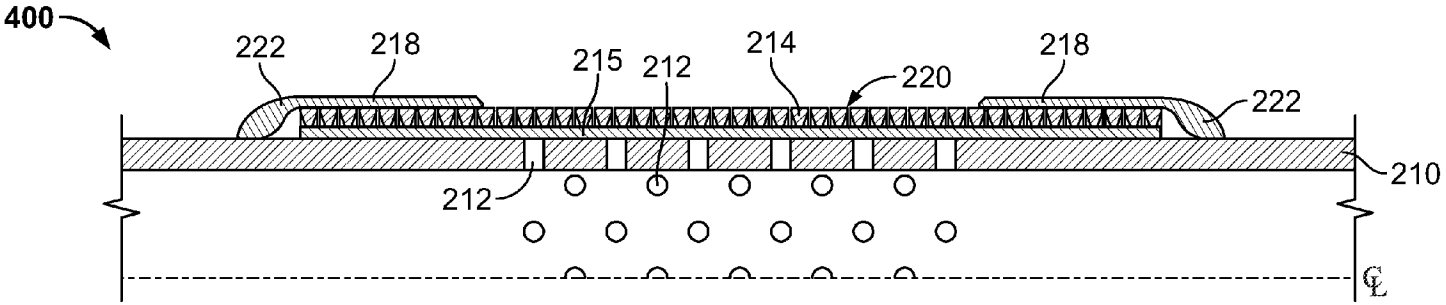
Figure 4B:
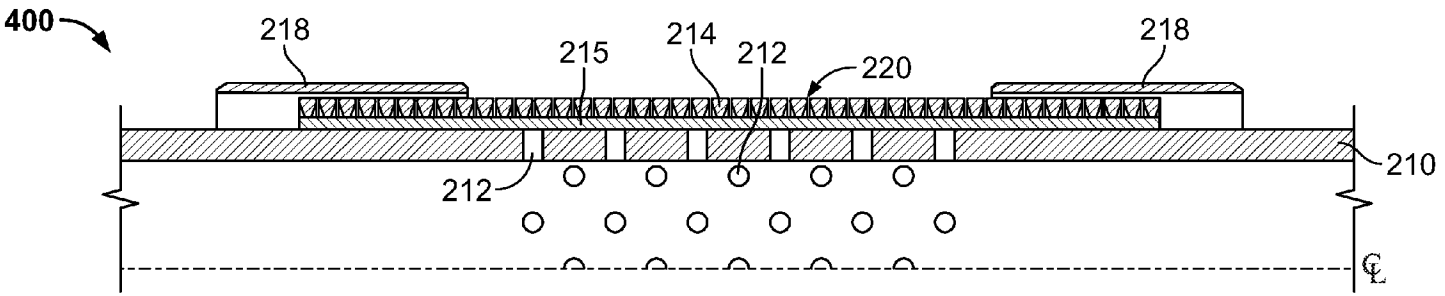
Figure 4C:
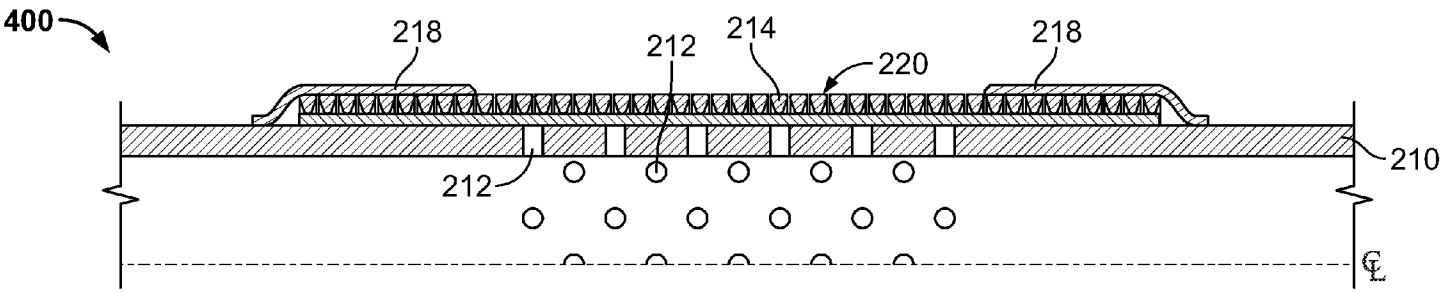

FIGS. 4A-4C are half side cross-sectional views of another well screen assembly 400 constructed in accordance with the concepts described herein. As with the well screen assembly 200 described above, the well screen assembly 400 includes a base pipe 210, a screen layer 220 formed of wire 214 helically wrapped around the base pipe 210, and a crimp ring 218. However, the end ring 216 is omitted and the crimp ring 218 is configured with enough material that it can be crimped both to the outer surface of the screen layer 220 and to the outer surface of the base pipe 210. Thereafter, the crimp ring 218 is welded to the base pipe 210 by forming beads of weld circumferentially around and contacting the interface between the crimp ring 218 and the base pipe 210.

A number of implementations have been described. Nevertheless, it will be understood that various modifications may be made without departing from the spirit and scope of the invention. Accordingly, other implementations are within the scope of the following claims.

What is claimed is:

1. A well screen assembly, comprising:

an elongate tubular base pipe defining apertures extending between the interior and exterior of the base pipe;

a screen layer carried on the base pipe and comprising a wire that has been wrapped helically around the exterior of the base pipe; and a crimp ring not welded to the screen layer and affixed to the base pipe and encircling the base pipe and an end of the screen layer, the crimp ring plastically deformed about an outer surface of the screen layer.

2. The well screen assembly of claim 1, further comprising an end ring affixed to the base pipe and encircling the base pipe, the crimp ring plastically deformed about an outer surface of the end ring.

3. The well screen assembly of claim 2, wherein the crimp ring is welded to the end ring, and the end ring is welded to the base pipe.

4. The well screen assembly of claim 2, wherein the end ring is split.

5. The well screen assembly of claim 4, wherein the end ring comprises a plurality of arcuate ring segments assembled about the base pipe.

6. The well screen assembly of claim 1, wherein the crimp ring is welded to the base pipe.

7. The well screen assembly of claim 1, wherein the crimp ring is deformed into contact with the outer surface of the screen layer.

8. The well screen assembly of claim 1, wherein a material of the screen layer and a material of the base pipe are incompatible for welding.

9. The well screen assembly of claim 1, further comprising a second crimp ring affixed to the base pipe and encircling the base pipe and a second end of the screen layer, the second crimp ring plastically deformed about the outer surface of the screen layer.

10. A method for constructing a well screen, comprising:

positioning a crimp ring encircling and over an end of a wrapped-on-pipe screen layer on a tubular base pipe;

plastically deforming the crimp ring about an outer surface of the screen layer and securing the crimp ring about the outer surface of the screen layer without welding the crimp ring to the screen layer; and applying a bead of weld to affix the crimp ring to the base pipe.

11. The method of claim 10, further comprising positioning an end ring encircling the base pipe and adjacent the screen layer and plastically deforming the crimp ring about an outer surface of the end ring.

12. The method of claim 11, wherein applying beads of weld to affix the crimp ring to the base pipe comprises welding the crimp ring to the end ring, and welding the end ring to the base pipe.

13. The method of claim 11, wherein the end ring is split and positioning the end ring encircling the base pipe comprises passing the end ring laterally over the base pipe.

14. The method of claim 11, wherein the end ring comprises a plurality of arcuate ring segments, and positioning the end ring encircling the base pipe comprises assembling the end ring segments around the base pipe.

15. The method of claim 10, wherein plastically deforming the crimp ring about an outer surface of the screen layer comprises plastically deforming the crimp ring into contact with the outer surface of the screen layer.

16. The method of claim 10, further comprising:

positioning a second crimp ring encircling and over a second end of the screen layer;

plastically deforming the second crimp ring about the outer surface of the screen layer; and applying a bead of weld to affix the second crimp ring to the base pipe.

17. A method, comprising:

wrapping a wire helically around a base pipe to define a screen layer;

introducing a crimp ring over an end of the screen layer; and plastically deforming the crimp ring around the screen layer and securing the screen layer to the base pipe without welding the crimp ring to the screen layer.

18. The method of claim 17, further comprising:

introducing an end ring laterally over the base pipe adjacent the end of the screen layer; and plastically deforming the crimp ring around the end ring.

19. The method of claim 18, further comprising welding the end ring to the base pipe and welding the crimp ring to the end ring.

20. The method of claim 17, further comprising welding the crimp ring to the base pipe.

21. A well screen assembly, comprising:

an elongate tubular base pipe defining apertures extending between the interior and exterior of the base pipe;

a screen layer carried on the base pipe and comprising a wire that has been wrapped helically around the exterior of the base pipe;

a crimp ring affixed to the base pipe and encircling the base pipe and an end of the screen layer, the crimp ring plastically deformed about an outer surface of the screen layer; and an end ring affixed to the base pipe and encircling the base pipe, the crimp ring plastically deformed about an outer surface of the end ring.

22. A well screen assembly, comprising:

an elongate tubular base pipe defining apertures extending between the interior and exterior of the base pipe;

a screen layer carried on the base pipe and comprising a wire that has been wrapped helically around the exterior of the base pipe; and a crimp ring affixed to the base pipe and encircling the base pipe and an end of the screen layer, the crimp ring plastically deformed about an outer surface of the screen layer, a material of the screen layer and a material of the base pipe are incompatible for welding.

23. A method for constructing a well screen, comprising:

positioning a crimp ring encircling and over an end of a wrapped-on-pipe screen layer on a tubular base pipe;

plastically deforming the crimp ring about an outer surface of the screen layer;

applying a bead of weld to affix the crimp ring to the base pipe; and positioning an end ring encircling the base pipe and adjacent the screen layer and plastically deforming the crimp ring about an outer surface of the end ring.

24. A method, comprising:

wrapping a wire helically around a base pipe to define a screen layer;

introducing a crimp ring over an end of the screen layer;

plastically deforming the crimp ring around the screen layer and securing the screen layer to the base pipe;

introducing an end ring laterally over the base pipe adjacent the end of the screen layer; and plastically deforming the crimp ring around the end ring.

* * * * *

UNITED STATES PATENT AND TRADEMARK OFFICE

CERTIFICATE OF CORRECTION

PATENT NO. : 8,291,971 B2
APPLICATION NO. : 12/855932
DATED : October 23, 2012
INVENTOR(S) : Gregory F. Cunningham and Jean-Marc Lopez It is certified that error appears in the above-identified patent and that said Letters Patent is hereby corrected as shown below:

Column 6, Line 30, in Claim 13, delete "split" and insert -- split, --, therefor.

Signed and Sealed this
Twenty-ninth Day of January, 2013

David J. Kappos

David J. Kappos
*Director of the United States Patent and Trademark Office*